US007148413B2

(12) United States Patent
May

(10) Patent No.: US 7,148,413 B2
(45) **Date of Patent: *Dec. 12, 2006**

(54) DRUM WITH MODULATED ACOUSTICAL AIR VENT

(76) Inventor: Randall L May, 2 Trafalgar, Newport Beach, CA (US) 92660-6830

( * ) Notice: Subject to any disclaimer, the term of this patent is extended or adjusted under 35 U.S.C. 154(b) by 0 days.

This patent is subject to a terminal disclaimer.

(21) Appl. No.: 11/123,915

(22) Filed: May 6, 2005

(65) Prior Publication Data

US 2005/0188816 A1 Sep. 1, 2005

Related U.S. Application Data

(63) Continuation-in-part of application No. 10/602,017, filed on Jun. 24, 2003, now Pat. No. 6,927,330.

(51) Int. Cl.
*G10D 13/02* (2006.01)

(52) U.S. Cl. ..... 84/411 R

(58) Field of Classification Search ..... 84/411 N, 84/412, 421

See application file for complete search history.

(56) References Cited

U.S. PATENT DOCUMENTS 4,060,019 A * 11/1977 Cordes ..... 84/411 R
6,700,044 B1 * 3/2004 Bencomo, Jr. ..... 84/411 R
2003/0029302 A1 * 2/2003 Reed ..... 84/411 R
2005/0120863 A1 * 6/2005 Dunnett ..... 84/411 R

* cited by examiner

*Primary Examiner*—Kimberly Lockett
(74) *Attorney, Agent, or Firm*—Kirk A. Buhler; Buhler & Associates

(57) ABSTRACT

A tunable drum having a hollow drum shell, and imperforate drumhead closing at least one end of said drum shell. One or more opening extend through the drum shell for acoustic venting, and valves are provided for adjusting the size of the openings to vary the amount of acoustic venting, effecting the drums volume, pitch, tone, timbre and stick or hand response. The valves may be movable slid valves, e.g., slidable or pivotable, between an open and a closed position or "F-holes". Valves may consist of a ring member positioned for rotation inside said drum and slidable endwise of the drum to cover or uncover said drum openings, or the ring member may have openings that match the drum openings and operable to cover or uncover the openings or rotation. A handle for rotation of the ring member extends outside the shell for movement by the drummer.

20 Claims, 10 Drawing Sheets

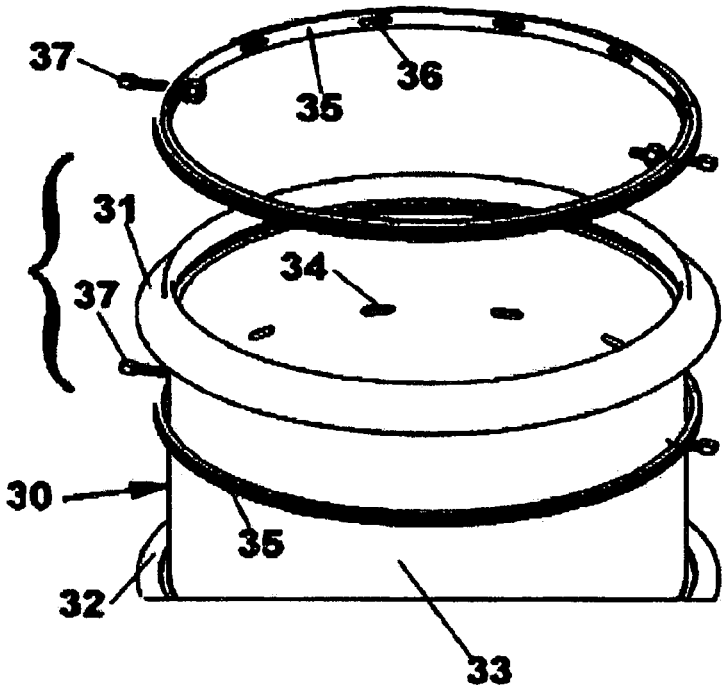
Fig. 3
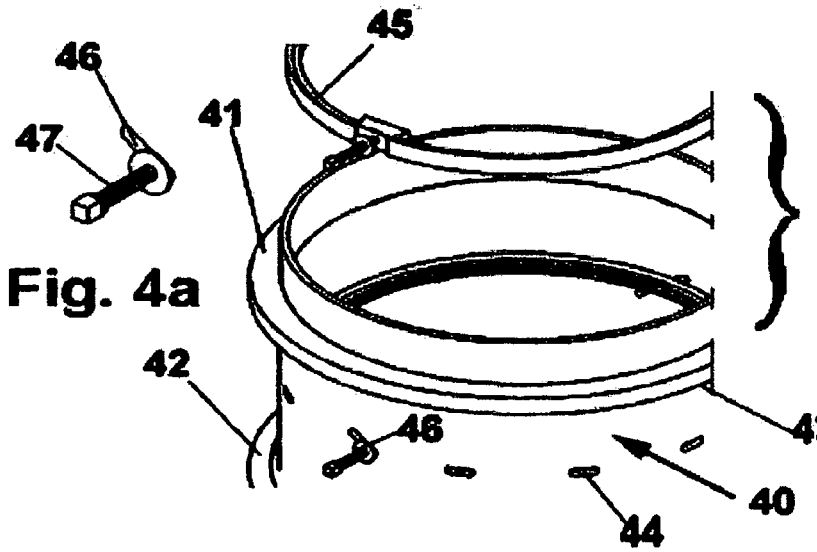
Fig. 4a
Fig. 4

DRUM WITH MODULATED ACOUSTICAL AIR VENT

CROSS REFERENCE TO RELATED APPLICATION

This application is a continuation-in-part of applicant's application Ser. No. 10/602,017 now U.S. Pat. No. 6,927,330 filed Jun. 24, 2003

BACKGROUND OF THE INVENTION

Field of the Invention

This invention shows new and improved drum assemblies having a modulated acoustic air vents.

Conventional drums consist of a hollow drum shell having one or more drumheads held in place by head hoops. Conventional drums may have an acoustic air vent but they are not adjustable in size.

The prior art discloses many examples of apparatus for supporting percussion instruments but none providing the combination of features disclosed and claimed needs.

SUMMARY OF THE INVENTION

It is therefore an object of the present invention to provide a new and improved drum assembly that is tunable in use to vary the pitch thereof.

Another object of the invention is to provide a new and improved drum assembly having means to adjust air exhausting from the drum to vary the tone of the drum.

Another object of the invention is to provide a new and improved drum assembly having an air vent controllable in size to vary the tone of the drum.

Another object of the invention is to provide a new and improved drum assembly having an air vent controllable in size to vary the stick and or hand response of the drum.

Another object of the invention is to provide a new and improved drum assembly having an air vent controllable in size to vary the volume of the drum.

Another object of the invention is to provide a new and improved drum assembly having an air vent controllable in size to vary the timbre of the drum.

Another object of the invention is to provide a new and improved drum assembly having an air vent comprising openings controllable in size to vary the tone of the drum during use.

Another object of the invention is to provide a new and improved drum assembly having a plurality of air vent openings and valve means operable adjust the size of the openings in size to vary the tone of the drum.

Another object of the invention is to provide a new and improved drum assembly having a plurality of air vent openings and individually worked valve means operable adjust the size of the openings in size to vary the tone of the drum.

Another object of the invention is to provide a new and improved drum assembly having a plurality of air vent openings and simultaneously worked valve means operable adjust the size of the openings in size to vary the tone of the drum.

Various objects, features, aspects, and advantages of the present invention will become more apparent from the following detailed description of preferred embodiments of the invention, along with the accompanying drawings in which like numerals represent like components.

BRIEF DESCRIPTION OF THE DRAWINGS

FIG. 3 is an exploded isometric view of a standard drum assembly showing a drum shell having a plurality of acoustic air vent holes next to the upper drumhead, and a ring member positioned outside to vary the size of the air vent openings.

FIG. 4 is an exploded isometric view of a standard drum assembly showing a drum shell having a plurality of acoustic air vent holes beside the upper drumhead, having a ring member positioned inside the shell to vary the size of the air vent openings, and showing a wedge member in the ring member for locking it in place.

FIG. 4*a* is an isometric detail view of the locking bolts used in FIG. 4.

DESCRIPTION OF PREFERRED EMBODIMENTS

EXAMPLE 1

Figure 1:
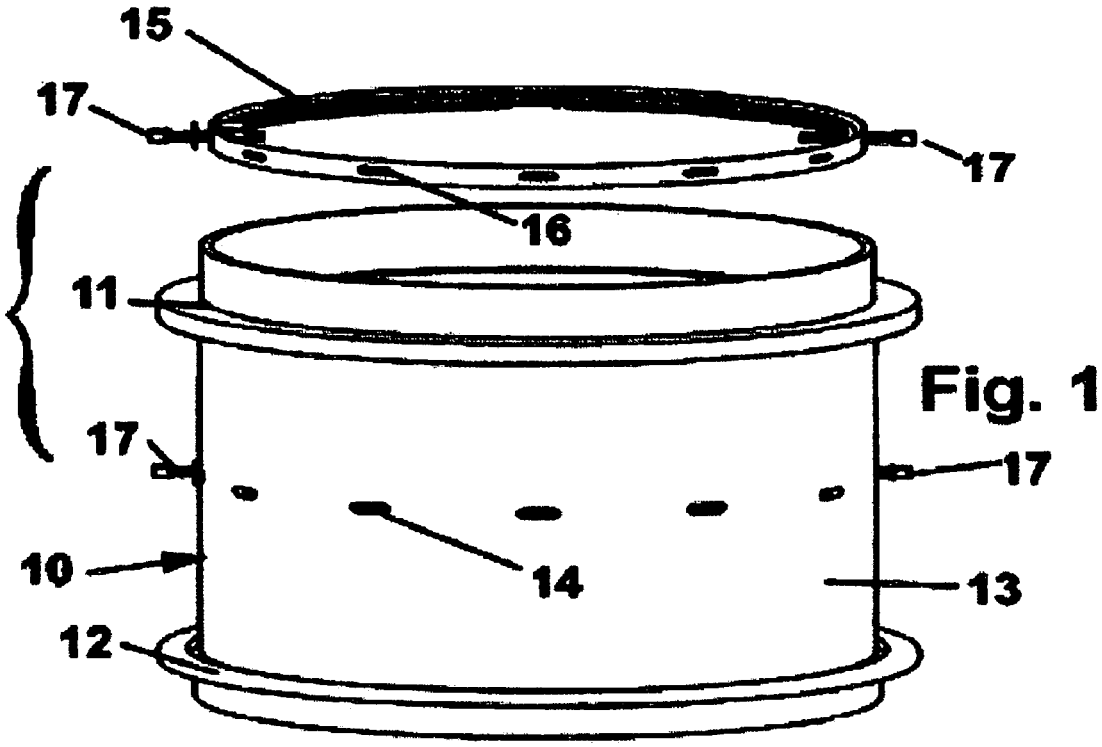
FIG. 1 is an exploded isometric view of a standard drum assembly showing a drum shell with a plurality of acoustic air vent holes midway up the shell, and a ring member positioned inside to vary the size of the air vent openings.

Referring to the drawings by numerals of reference, and more particularly to FIG. 1 there is a drum assembly 10 having upper and lower drumheads.

Conventional adjusting screws secure tensioning hoops 11 and 12 to lugs on drum shell 13. Adjustment of the bolts or screws varies the tension in the drumhead skin or diaphragm to tune the sound output of the drumheads.

Drum shell 13 has a plurality of acoustic vent openings or slots 14 positioned about halfway up the shell allowing air to exit from the interior of the drum. The adjustment of the acoustic openings allows variation in venting of air from the drum for controlling volume, pitch, tone, timbre, and stick or hand response.

A ring member 15 with slots 16, shown exploded above the drum shell, has a sliding fit inside drum shell 13 with slots 16 aligned with slots 14 when fully opened and movable on rotation to a position closing slot 14. Bolts 17, having square heads operated by a drum key, extend through a pair of slots 14 on opposite sides of the drum shell, and, on tightening, secure ring member 15 in place.

Operation

With the drumhead secured on the open upper end of drum shell 13, the drum is ready for use. Bolts 17 operated by a drum key allow rotation of ring 15 to any needed position between fully open (slots 14 and 16 fully aligned) and fully closed (the imperforate portion of ring 15 covering slots 14). This adjustment of the acoustic openings allows variation in venting of air from the drum for controlling volume, pitch, tone, timbre, and stick or hand response.

EXAMPLE 2

Figure 2:
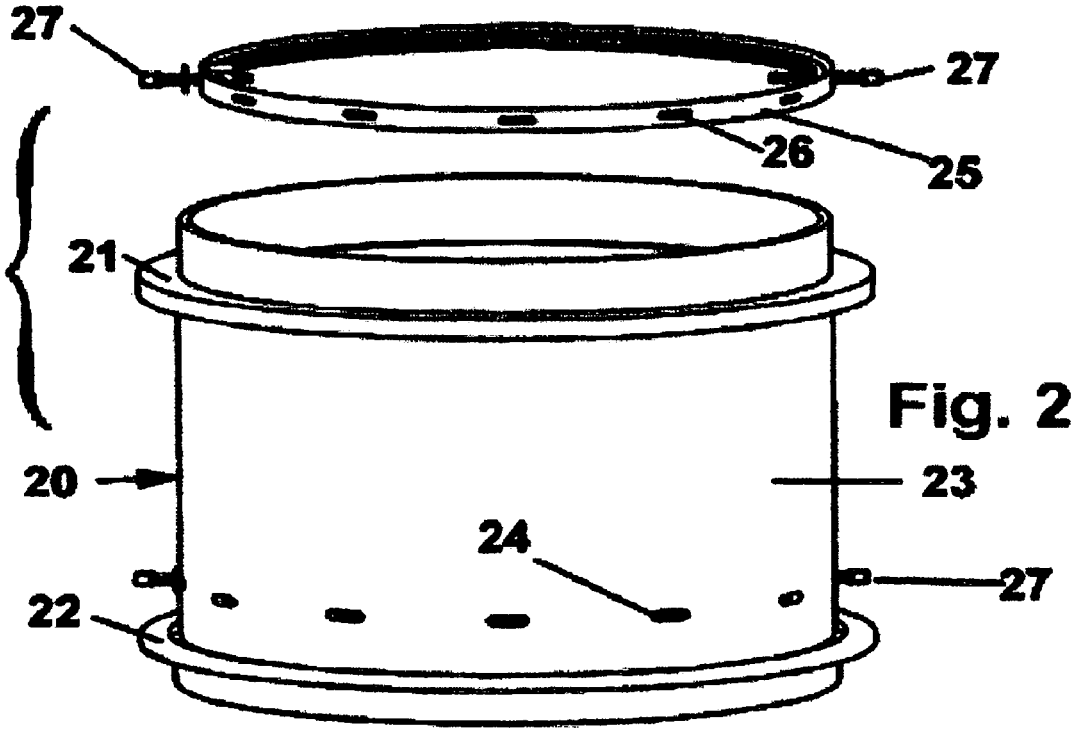
FIG. 2 is an exploded isometric view of another drum assembly showing a drum shell having a plurality of acoustic air vent holes next to the lower drumhead and a ring member positioned inside to vary the size of the air vent openings.

Referring to the drawings by numerals of reference, and especially to FIG. 2, there is a drum assembly 20 having upper and lower drum tensioning rings 21 and 22 supported on drum shell 23. Conventional adjusting screws secure drum-tensioning rings 21 and 22 on the drum shell 23. Adjustment of the bolts or screws varies the tension in the drumhead skin or diaphragm to tune the sound of the drumheads.

Drum shell 23 has a plurality of acoustic vent openings or slots 24 positioned next to the lower drumhead, which allow air to exit from the interior of the drum. This adjustment of the acoustic openings allows variation in venting of air from the drum for controlling volume, pitch, tone, timbre, and stick or hand response.

A ring member 25 with slots 26, shown exploded above the drum shell, has a sliding fit inside drum shell 23, with slots 26 aligned with slots 24 when fully opened, and movable on rotation to a position closing slots 24. Bolts 27, having square heads worked by a drum key, extend through a pair of slots 24 on opposite sides of the drum shell, and on tightening secure ring member 25 in place.

Operation

When the drumhead is secured on the open upper end of drum shell 23, the drum is ready for use. Bolts 27, operated by a drum key, allow rotation of ring 25 to any needed position between fully open (slots 24 and 26 fully aligned) and fully closed (the imperforate portion of ring 25 covering slots 24). This adjustment of the acoustic openings allows variation in venting of air from the drum for controlling volume, pitch, tone, timbre, and stick or hand response

EXAMPLE 3

Referring to the drawings by numerals of reference, and especially to FIG. 3 shows a drum assembly 30 having upper and lower drum tensioning hoops 31 and 32 supported on drum shell 33. Conventional adjusting screws secure drum-tensioning hoops 31 and 32 to lugs on the drum shell. Adjustment of the bolts or screws varies the tension in the drumhead skin or diaphragm to tune the sound of the drumheads.

Drum shell 33 has a plurality of acoustic vent openings or slots 34 positioned next to the lower drumhead, which allows air to exit from the interior of the drum. This adjustment of the acoustic openings allows variation in venting of air from the drum for controlling volume, pitch, tone, timbre, and stick or hand response.

A ring member 35 with slots 36, shown exploded above the drum shell, has a sliding fit outside the drum shell 33. Slots 36 are aligned with slots 34 when fully opened and movable on rotation to a position closing slots 34. Bolts 37, having square heads, worked by a drum key, extend through a pair of slots 34 on opposite sides of the drum shell, and on tightening secure ring member 35 in place.

Operation

With the drumhead secured on the open upper end of drum shell 33, the drum is ready for use. Bolts 37, worked by a drum key, allow rotation of ring 35 to any needed position between fully open (slots 34 and 36 fully aligned) and fully closed (the imperforate portion of ring 35 covering slots 34). This adjustment of the acoustic openings allows variation in venting of air from the drum for controlling volume, pitch, tone, timbre, and stick or hand response.

EXAMPLE 4

Referring to the drawings by numerals of reference, and especially to FIGS. 4 and 4*a* shows a drum assembly 40 having upper and lower drum tensioning hoops 41 and 42 supported on drum shell 43. Conventional adjusting screws secure drum-tensioning hoops 41 and 42 to lugs on the drum shell 43. This adjustment of the acoustic openings allows variation in venting of air from the drum for controlling volume, pitch, tone, timbre, and stick or hand response.

Drum shell 43 has a plurality of acoustic vent openings or slots 44 positioned next to the lower drumhead, which allows air to exit from the interior of the drum, avoiding a dampening of the sound that would occur in a tightly closed drum.

An imperforate ring member 45, shown exploded above the drum shell, has a sliding fit up and down inside the drum shell 43 to cover and uncover slot 44. Bolts 47, having square heads worked by a drum key, extend through a pair of angled slots 46 on opposite sides of the drum shell, and on tightening secure ring member 45 in place.

Operation

With the drumhead secured on the open upper end of drum shell 43, the drum is ready for use. Bolts 47 worked by a drum key move in angled slots 46 to move ring 45 to any needed position between fully open and fully closed. This adjustment of the acoustic openings allows variation in venting of air from the drum for controlling volume, pitch, tone, timbre, and stick or hand response.

EXAMPLE 5

Figure 5:
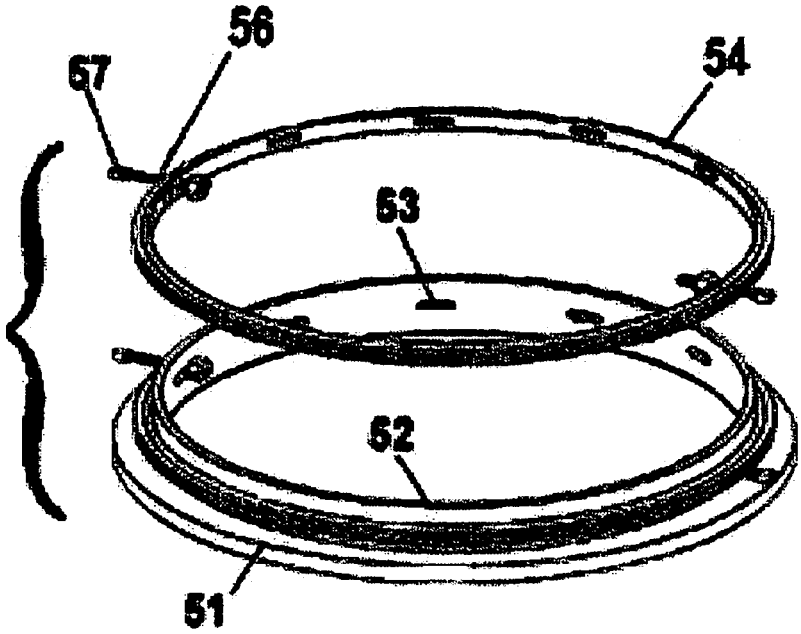
FIG. 5 is an exploded view of a drumhead ring having air vent openings and a ring member positioned outside to vary the size of the air vent openings.

Referring to the drawings by numerals of reference, and especially to FIG. 5, shows an upper drum tensioning hoop or ring 51 supported on a drum shell as in the other Examples. Ring 51 has a rim 52 with a plurality of acoustic slots 53.

A ring member 54, shown exploded above the drum rim 52, has slots 55, which match slots 53 on assembly. Bolts 56, having square heads 57 for operation by a drum key, extend through a pair of the slots 53, 55 on opposite sides of the drum ring member 54. Bolts 56, when extended, may rotate ring member 54, to secure it in place.

Ring member 54 positioned outside rim 52 may be rotated. Slots 53, 55 are acoustic vent openings matching to the ones in the other examples, which allows air to exit from the interior of the drum. This adjustment of the acoustic openings allows variation in venting of air from the drum for controlling volume, pitch, tone, timbre, and stick or hand response.

Operation

With the drumhead secured on the open upper end of a drum shell, the drum is ready for use. Bolts 56 worked by a drum key move in slots 53 to position member 54 at any needed location of slots 53, between fully open and fully closed. This adjustment of the acoustic openings allows variation in venting of air from the drum for controlling volume, pitch, tone, timbre, and stick or hand response.

EXAMPLE 6

Figure 6:
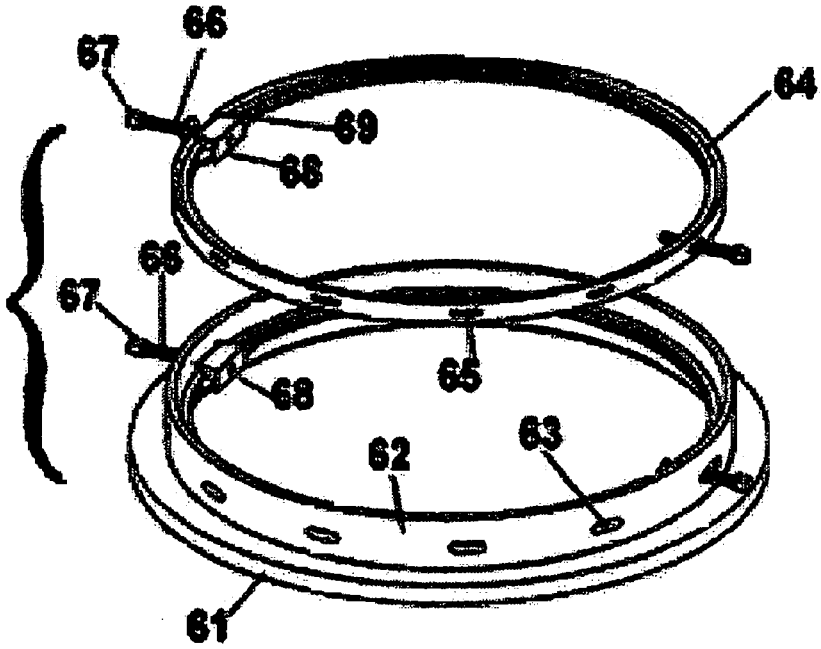
FIG. 6 is an exploded view of a drumhead ring having air vent openings and a ring member positioned inside to vary the size of the air vent openings, and showing a wedge member in the ring member for locking it in place.

Referring to the drawings by numerals of reference, and especially to FIG. 6, shows an upper drum tensioning hoop or ring 61 to be supported on a drum shell as in the other Examples. Ring 61 has a rim 62 with a plurality of acoustic slots 63.

A ring member 64, shown exploded above the drum rim 62, has slots 65, which match slots 63 on assembly and is split at 69. Bolts 66, having square heads 67 worked by a drum key, extend through a pair of the slots 63, 65 on opposite sides of the drum ring member 64. Bolts 66, when extended, are used to rotate ring member 64. A wedge member 68 fits between the ends of split 69, and, on tightening of one of the bolts 66, secures ring member 64 in place.

With ring member 64 positioned inside rim 62, it may be rotated. Slots 63, 65 are acoustic vent openings similar to the ones in the other examples. This adjustment of the acoustic openings allows variation in venting of air from the drum for controlling volume, pitch, tone, timbre, and stick or hand response.

Operation

With the drumhead secured on the open upper end of a drum shell, the drum is ready for use. Bolts 67 operated by a drum key and move in slots 63 to move ring member 64 to any needed position of slots 63, 65 between fully open and fully closed. This adjustment of the acoustic openings allows variation in venting of air from the drum for controlling volume, pitch, tone, timbre, and stick or hand response. Wedge member 68 fits between the ends of split 69, and, on tightening of one of the bolts 66, secures ring member 64 in place.

EXAMPLE 7

Figure 7:
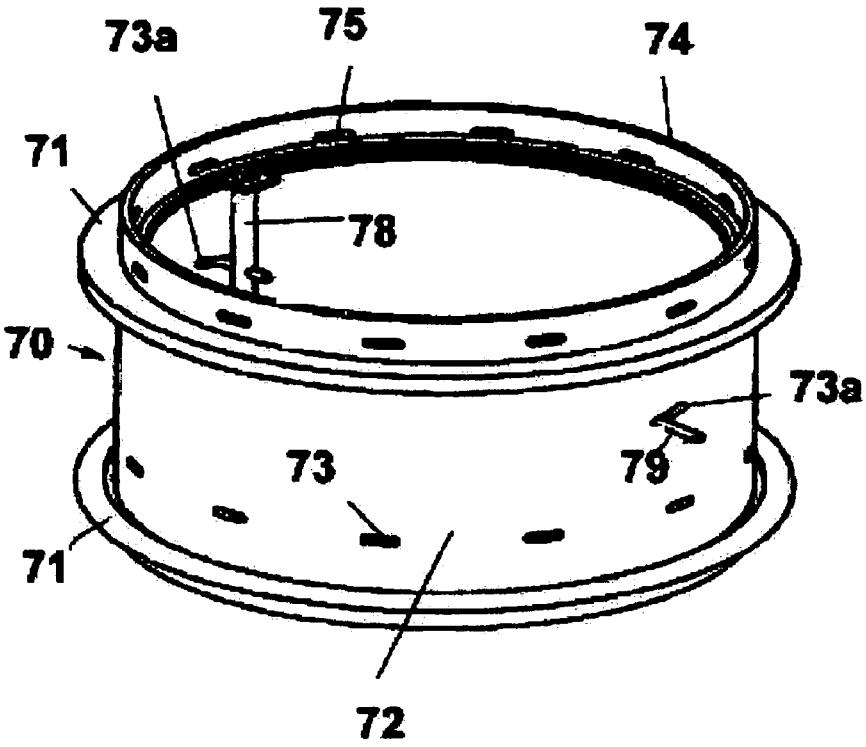
FIG. 7 is an isometric view of a standard drum assembly showing a drum shell having one plurality of acoustic air vent holes next to the bottom drumhead, and a drumhead ring having air vent openings, and a pair of ring members positioned inside the shell to vary the size of the air vent openings, and showing a member for using the ring members together.
Figure 7A:
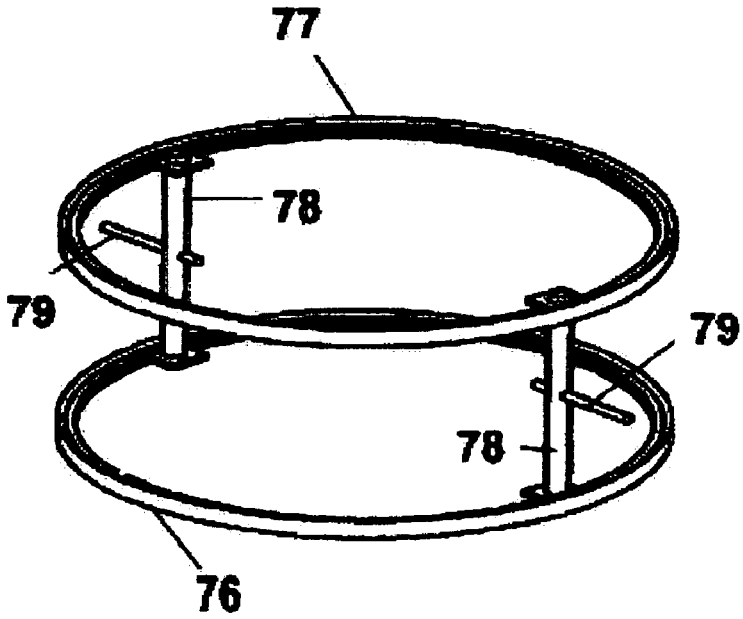
FIG. 7*a* is an isometric view of the pair of ring members shown in FIG. 7.

Referring to the drawings by numerals of reference, and especially to FIGS. 7 and 7A shows a drum assembly 70 with upper and lower drum tensioning hoops 71 supported on drum shell 72. Drum tensioning hoops 71 and 72 are secured on the drum shell 72 by conventional adjusting screws. Adjustment of the bolts or screws varies the tension in the drumhead skin or diaphragm to tune the sound of the drumheads.

Drum shell 72 has a plurality of acoustic vent openings or slots 73 positioned near the lower hoop 71. Upper hoop 71 has a rim 74 with slots 75, which, with slots 73, allow air to exit from the interior of the drum. This adjustment of the acoustic openings allows variation in venting of air from the drum for controlling volume, pitch, tone, timbre, and stick or hand response.

Ring members 76 and 77 connected by braces 78, shown in FIG. 7A, have a sliding fit inside drum shell 72 with operating lever rods 79 extending through angled slots 73*a*. Ring members 76 and 77 are imperforate, and have sliding movement toward an end of the drum to cover or uncover slots 73 and 75.

Operation

Lever rods 79 are movable circumferentially in angled slots 73*a* to rotate ring members 76 and 77, and move them toward and away from an end of the drum shell to cover or uncover slots 73 and 75 to vary the venting of air from the drum and allow air to exit from the interior of the drum. This adjustment of the acoustic openings allows variation in venting of air from the drum for controlling volume, pitch, tone, timbre, and stick or hand response.

EXAMPLE 8

Referring to the drawings by numerals of reference, and especially to FIGS. 8, 8A, 8B, and 8C, shows a drum assembly 80 with upper and lower drum tensioning rings 81 supported on drum shell 82. Drum tensioning rings 81 are secured on the drum shell 82 by conventional adjusting bolts or screws extending from ring to ring. Adjustment of the bolts or screws varies the tension in the drumhead skin or diaphragm to tune the sound of the drumheads.

Drum shell 82 has a plurality of acoustic vent openings or slots 83 positioned near the lower hoop 81. Upper ring 81 has an upstanding rim 84 with slots 85, which, together with slots 83, allow air to exit from the interior of the drum.

Figure 8:
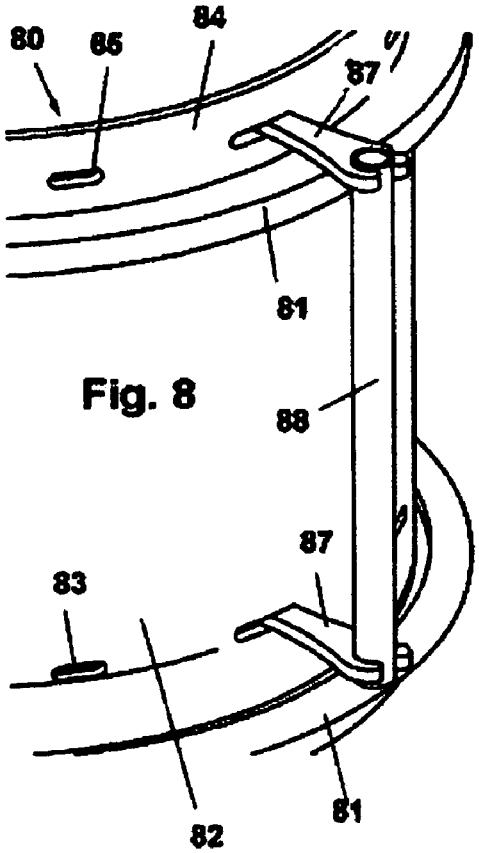
FIG. 8 is an isometric fragment view of a standard drum assembly showing a drum shell having one plurality of acoustic air vent holes beside to the bottom drumhead, and a drumhead ring having air vent openings, and a pair of ring members positioned inside the shell to vary the size of the air vent openings, and showing external members for working the ring members together.
Figure 8A:
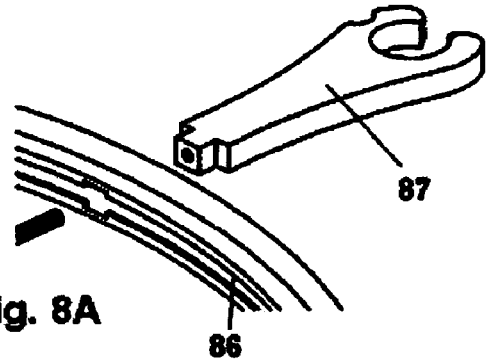
FIG. 8*a* is an exploded isometric fragment view of one of the ring members shown in FIG. 8 and one of the external members for working the ring members.
Figure 8B:
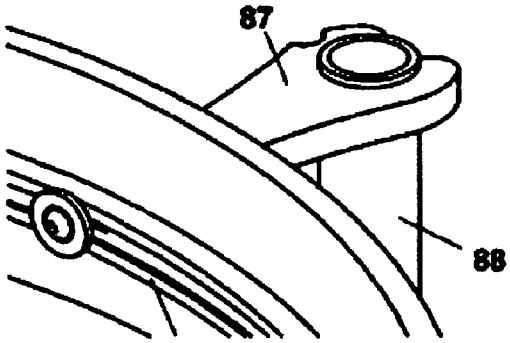
FIG. 8*b* is an exploded isometric fragment view of one of the ring members shown in FIG. 8 and the handle of the external members for operating the ring members.
Figure 8C:
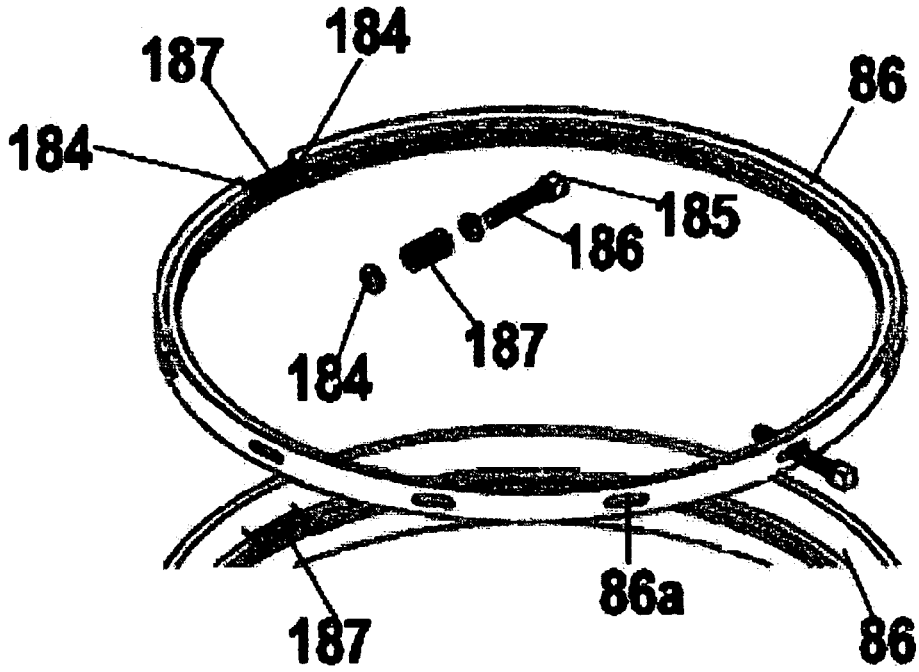
FIG. 8*c* is an exploded isometric fragment view of one of the ring members shown in FIG. 8 with a spring applying compression to expand the ring member, and a bolt for connecting an external member supporting a handle for working the ring members.

Split ring members 86 (FIG. 8C) have a coil spring 187 spreading the ring after being inserted for use. Coil spring 187 is fitted over a bolt 186 having a head 185 and washers 184. Ring members 86 have a sliding fit inside drum shell 82 with slots 86*a* matching slots 83 and 85. Operating levers 87 connected by handle 88, shown in FIGS. 8 and 8B, are movable to make the ring slots 86*a* cover or uncover slots 83 and 85. This adjustment of the acoustic openings allows variation in venting of air from the drum for controlling volume, pitch, tone, timbre, and stick or hand response.

Operation

Handle 88 rotates ring members 86, and moves them to cover or uncover slots 83 and 85 to vary the venting of air from the drum and allows air to exit from the interior of the drum. This adjustment of the acoustic openings allows variation in venting of air from the drum for controlling volume, pitch, tone, timbre, and stick or hand response. Coil spring 187 keeps ring members 86 expanded inside drum shell 82 and drum ring 84.

EXAMPLE 9

Figure 9:
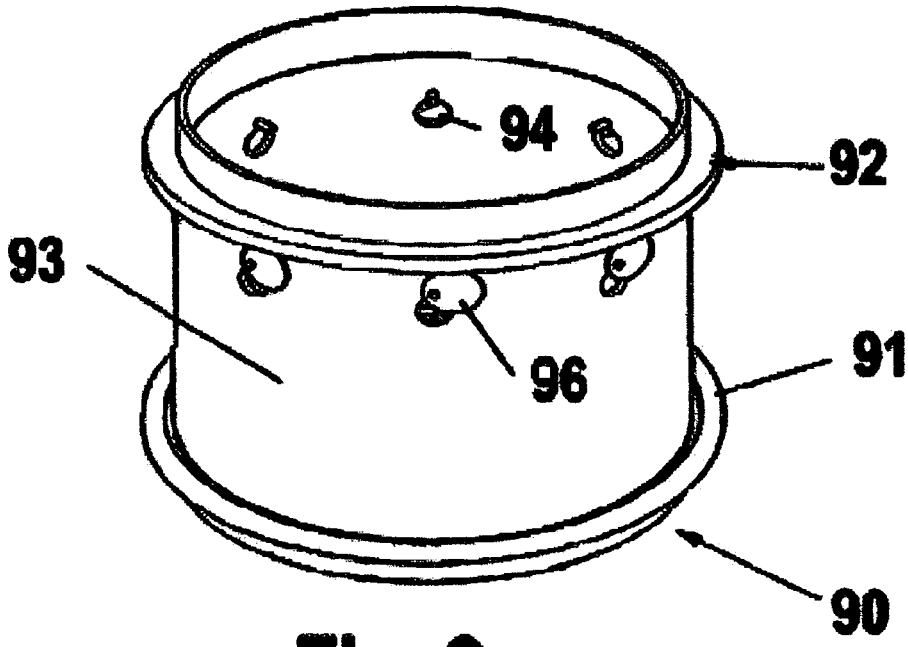
FIG. 9 is an isometric view of a standard drum assembly showing a drum shell having a plurality of acoustic air vent holes beside to the top drumhead, and disk members rotatable back and forth to vary the size of the air vent openings.

Referring to the drawings by numerals of reference, and especially to FIG. 9 shows a drum assembly 90 with upper and lower drum tensioning hoops 91 and 92 supported on drum shell 93. Conventional adjusting screws secure drum-tensioning hoops 91 and 92 on the drum shell 93. Adjustment of the bolts or screws varies the tension in the drumhead skin or diaphragm to tune the sound of the drumheads.

Drum shell 93 has a plurality of acoustic vent openings 94, which allow air to exit from the interior of the drum. Valve disks 96 are positioned next to each opening 94, and are pivotable side to side to open or close the vent openings. This adjustment of the acoustic openings allows variation in venting of air from the drum for controlling volume, pitch, tone, timbre, and stick or hand response.

Operation

With the drumhead secured on the open upper end of drum shell 93, the drum is ready for use. Adjustment of the acoustic openings 94 by movement of disks 96 allows a variation in venting of air from the drum. This adjustment of the acoustic openings allows variation in venting of air from the drum for controlling volume, pitch, tone, timbre, and stick or hand response.

EXAMPLE 10

Figure 10:
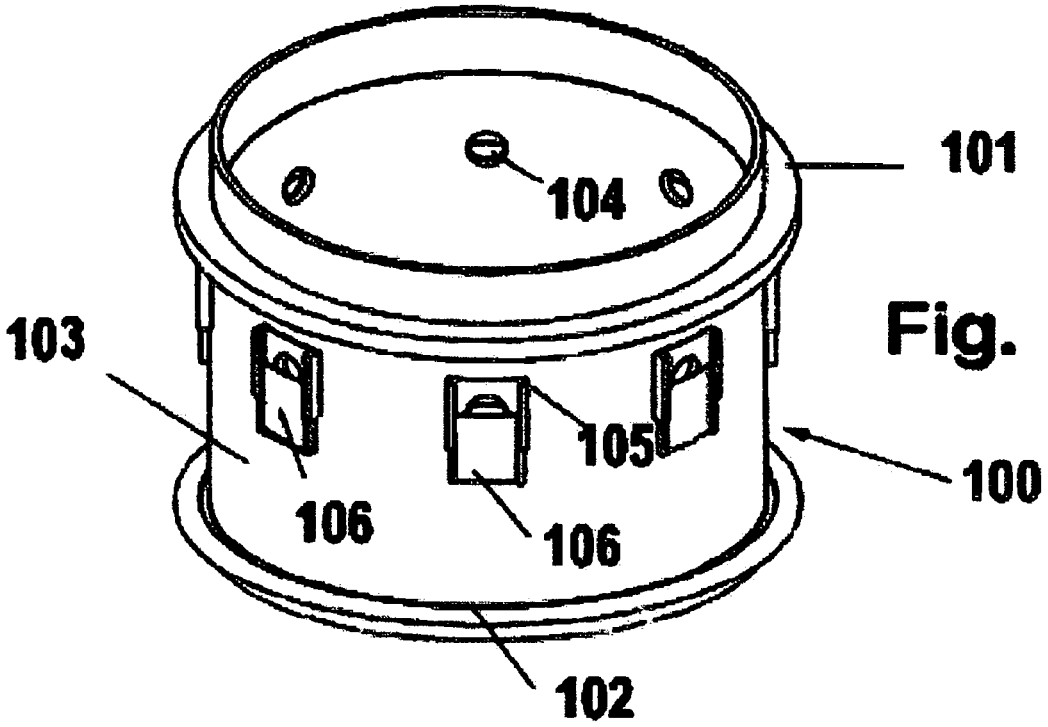
FIG. 10 is an isometric view of a standard drum assembly showing a drum shell having a plurality of acoustic air vent holes beside to the top drumhead, and slide members slidable up and down to vary the size of the air vent openings.

Referring to the drawings by numerals of reference, and especially to FIG. 10 shows a drum assembly 100 having upper and lower drum tensioning hoops 101 and 102 supported on drum shell 103. Conventional adjusting screws secure drum-tensioning hoops 101 and 102 on the drum shell 103. Adjustment of the bolts or screws varies the tension in the drumhead skin or diaphragm to tune the sound output of the drumheads.

Drum shell 103 has a plurality of acoustic vent openings 104, which allow air to exit from the interior of the drum. Valve slides 106 are supported close to each of the vent openings 104 in guides 105 and movable to close the openings. This adjustment of the acoustic openings allows variation in venting of air from the drum for controlling volume, pitch, tone, timbre, and stick or hand response.

Operation

When the drumhead is secured on the open upper end of drum shell 103, the drum is ready for use. Adjustment of the acoustic openings 104 by movement of valve slides 106 allows a variation in venting of air from the drum. This adjustment of the acoustic openings allows variation in venting of air from the drum for controlling volume, pitch, tone, timbre, and stick or hand response.

EXAMPLE 11

Figure 11:
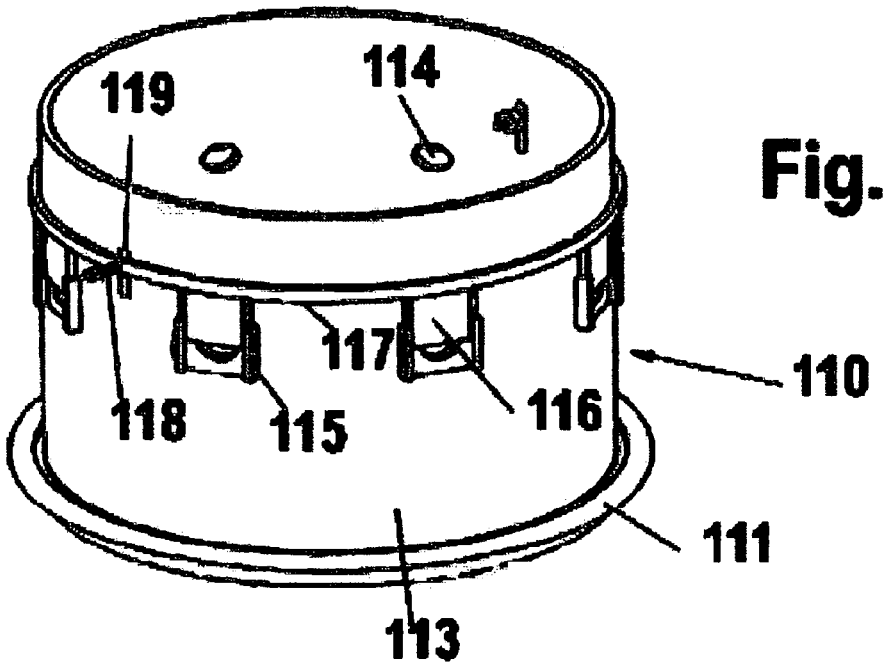
FIG. 11 is an isometric view of a standard drum assembly showing a drum shell having a plurality of acoustic air vent holes beside to the top drumhead, slide members slidable up and down to vary the size of the air vent openings, and a ring member connected to the slide members to move them up and down together.

Referring to the drawings by numerals of reference, and especially to FIG. 11 shows a drum assembly 110 with upper and lower drum tensioning hoops 111 (upper hoop not shown) supported on drum shell 113. Conventional adjusting screws secure drum-tensioning hoops 111 on the drum shell 113. Adjustment of the bolts or screws varies the tension in the drumhead skin or diaphragm to tune the sound of the drumheads.

Drum shell 113 has a plurality of acoustic vent openings 114, which allow air to exit from the interior of the drum. Guide members 115 are provided for each of the vent openings 114. Valve slides 116 are positioned in each of the guide members 115, and are slidable from a lower position opening said vent openings to an upper position closing the openings. Valve slides 116 are connected to a working ring 117 for simultaneous movement. A bolt 118 extends through ring 117 and slot 119 in drum shell 113 to secure the ring and valve slides in any selected position. This adjustment of the acoustic openings allows variation in venting of air from the drum for controlling volume, pitch, tone, timbre, and stick or hand response.

Operation

When the drumhead is secured on the open upper end of drum shell 113, the drum is ready for use. Adjustment of the acoustic openings 114 by movement of ring 117 and lid 116 allows a variation in venting of air from the drum. This adjustment of the acoustic openings allows variation in venting of air from the drum for controlling volume, pitch, tone, timbre, and stick or hand response.

EXAMPLE 12

Figure 12:
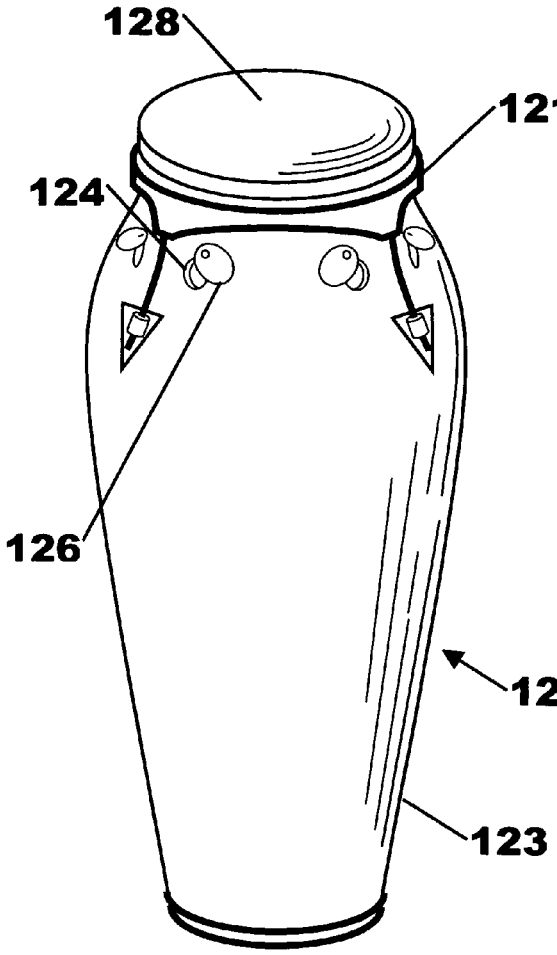
FIG. 12 is an isometric view of a standard Conga drum having a plurality of acoustical air vent holes beside to the top of the drumhead, and disk members rotatable back and forth to vary size of the air vent openings.

Referring to the drawings by numerals of reference, and especially to FIG. 12 shows a drum assembly 120 with the drum tensioning hoop 121 supported on drum shell 123. Conventional adjusting screws secure drum-tensioning hoop 121 on the drum shell 123. Adjustment of the bolts or screws varies the tension in the drumhead skin 128 or diaphragm to tune the sound of the drumheads.

Drum shell 123 has a plurality of acoustic vent openings 124, which allow air to exit from the interior of the drum. Valve disks 126 are positioned next to each opening 124, and are pivotable side to side to open or close the vent openings. This adjustment of the acoustic openings allows variation in venting of air from the drum for controlling volume, pitch, tone, timbre, and stick or hand response.

Operation

With the drumhead secured on the open upper end of drum shell 123, the drum is ready for use. Adjustment of the acoustic openings 124 by movement of disks 126 allows a variation in venting of air from the drum. This adjustment of the acoustic openings allows variation in venting of air from the drum for controlling volume, pitch, tone, timbre, and stick or hand response.

EXAMPLE 13

Figure 13:
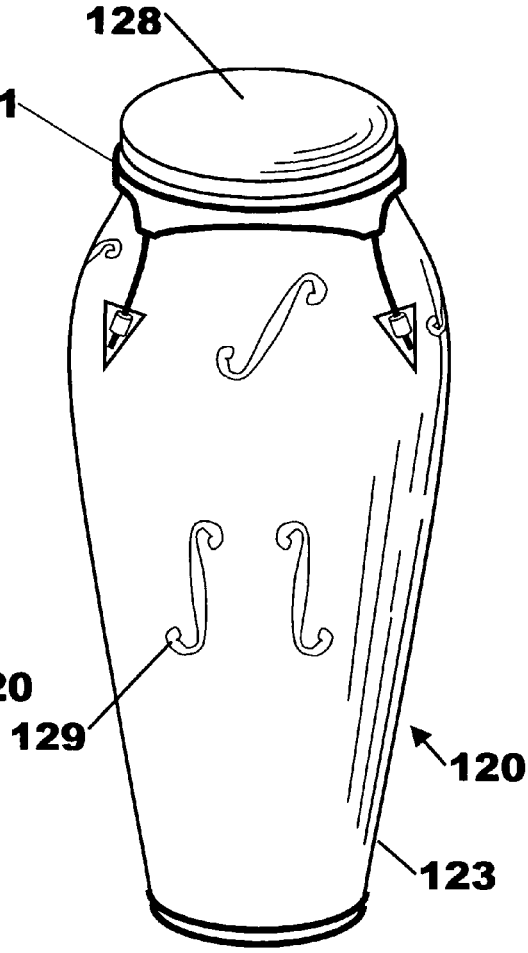
FIG. 13 is an isometric view of a standard Conga drum having an alternative plurality of "F-hole" acoustical air vent holes in the drum shell.

Referring to the drawings by numerals of reference, and especially to FIG. 13 shows a drum assembly 120 with the drum tensioning hoop 121 supported on drum shell 123. Conventional adjusting screws secure drum-tensioning hoop 121 on the drum shell 123. Adjustment of the bolts or screws varies the tension in the drumhead skin 128 or diaphragm to tune the sound of the drumheads.

Drum shell 123 has a plurality of "F" type 129 acoustic vent openings, which allow air to exit from the interior of the drum. The F holes are located in one or several places on the drum shell. The F holes are shown located both above and below the maximum girth of the drum shell. While the F holes are shown both above and below the maximum girth of the drum shell the F holes may be located either above or below on, or straddling the maximum girth of the drum shell. It is also contemplated that the F holes can be partially or completely covered to adjust the acoustic F hole openings allowing variation in venting of air from the drum for controlling volume, pitch, tone, timbre, and stick or hand response. This figure also shows the F holes placed in various locations and angles on the drum shell. While these angles and locations are shown for clarity on the design, other variations of shape, size, location and angles are contemplated.

Operation

With the drumhead secured on the open upper end of drum shell 123, the drum is ready for use. Adjustment of the acoustic openings 129 can be made by covering or filling part or all of the opening with a plug or using a sliding cover located internal or external of the drum shell to allow a variation in venting of air from the drum. This adjustment of the acoustic openings allows variation in venting of air from the drum for controlling volume, pitch, tone, timbre, and stick or hand response. The adjustment of the vents placed above the narrow portion of the drum and the vents placed below the narrow portion of the drum have different effect on the sound of the drum.

EXAMPLE 14

Figure 14:
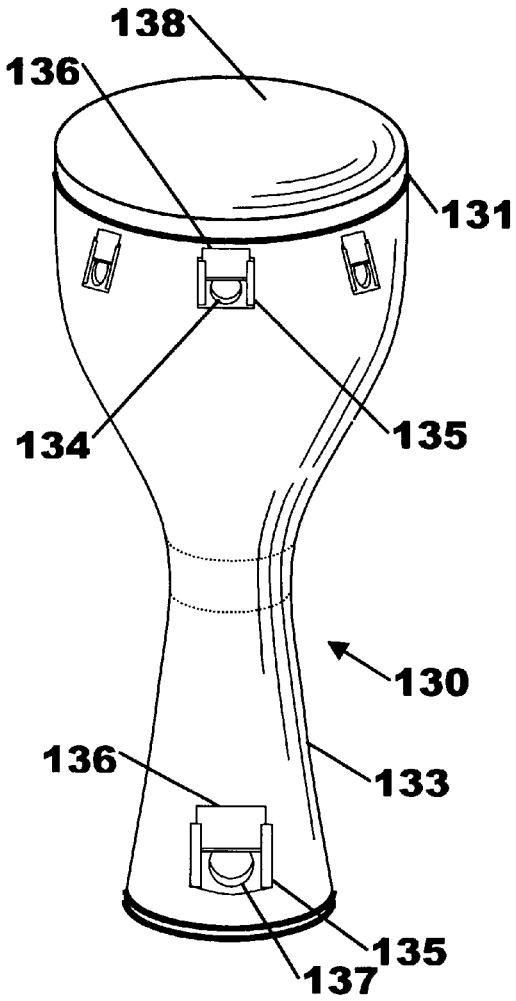
FIG. 14 is an isometric view of a standard Djembe drum having a plurality of acoustic air vent holes beside to the top drumhead, and slide members slidable up and down to vary the size of the air vent openings.

Referring to the drawings by numerals of reference, and especially to FIG. 14 shows a drum assembly 130 with drum tensioning hoop 131 supported on drum shell 133. Conventional adjusting screws secure drum-tensioning hoops 131 on the drum shell 133. Adjustment of the bolts or screws varies the tension in the drumhead skin 138 or diaphragm to tune the sound of the drumheads.

Drum shell 133 has a plurality of acoustic vent openings 134 located above the narrow portion of the drum shell and one or more vents 137 located below the narrow portion of the drum, which allow air to exit from the interior of the drum. Guide members 135 are provided for each of the vent openings 134. Valve slides 136 are positioned in each of the guide members 135, and are slidable from a lower position opening said vent openings to an upper position closing the openings. Valve slides 136 can be moved individually as disclosed in FIG. 11 or can be individually adjusted as disclosed in this FIG. 14. This adjustment of the acoustic openings allows variation in venting of air from the drum for controlling volume, pitch, tone, timbre, and stick or hand response.

Operation

When the drumhead is secured on the open upper end of drum shell 133, the drum is ready for use. Adjustment of the acoustic openings 134 by movement within the slides 136 allows a variation in venting of air from the drum. This adjustment of the acoustic openings allows variation in venting of air from the drum for controlling volume, pitch, tone, timbre, and stick or hand response. The adjustment of the vents placed above the narrow portion of the drum and the vents placed below the narrow portion of the drum have different effect on the sound of the drum.

EXAMPLE 15

Figure 15:
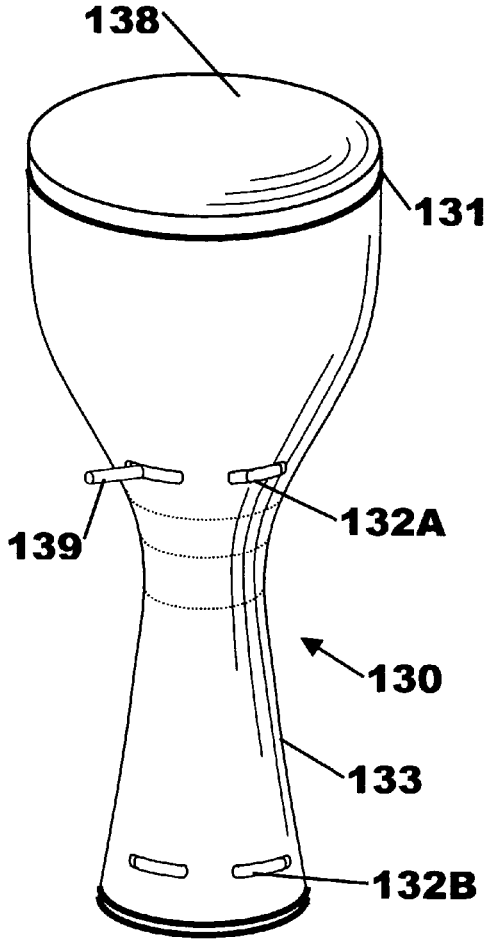
FIG. 15 is an isometric view of a standard Djembe drum having an alternative plurality of elliptical acoustic air vent holes in the mid and lower section of the drum, and slide members slidable to vary the size of the air vent openings.

Referring to the drawings by numerals of reference, and especially to FIG. 15 shows a drum assembly 130 with drum tensioning hoop 131 supported on drum shell 133. Conventional adjusting screws secure drum-tensioning hoops 131 on the drum shell 133. Adjustment of the bolts or screws varies the tension in the drumhead skin 138 or diaphragm to tune the sound of the drumheads.

Drum shell 133 has a plurality of acoustic vent openings 132A located above the narrow portion of the drum shell and one or more vents openings 132B located below the narrow portion of the drum, which allow air to exit from the interior of the drum. Vents 132A are shown with vent adjustment member 139 protruding through a vent opening. Valve adjuster 139 can be moved to vary the amount of venting from the all the valves connected to the valve adjuster. This type of adjustment mechanism is disclosed in FIG. 7 or an adjuster can be placed on each valve individually. This adjustment of the acoustic openings allows variation in venting of air from the drum for controlling volume, pitch, tone, timbre, and stick or hand response.

Operation

When the drumhead is secured on the open upper end of drum shell 133, the drum is ready for use. Adjustment of the acoustic openings 132A and 132B by movement within the slides 139 allows a variation in venting of air from the drum. This adjustment of the acoustic openings allows variation in venting of air from the drum for controlling volume, pitch, tone, timbre, and stick or hand response. The adjustment of the vents placed above the narrow portion of the drum and the vents placed below the narrow portion of the drum have different effect on the sound of the drum.

EXAMPLE 16

Figure 16:
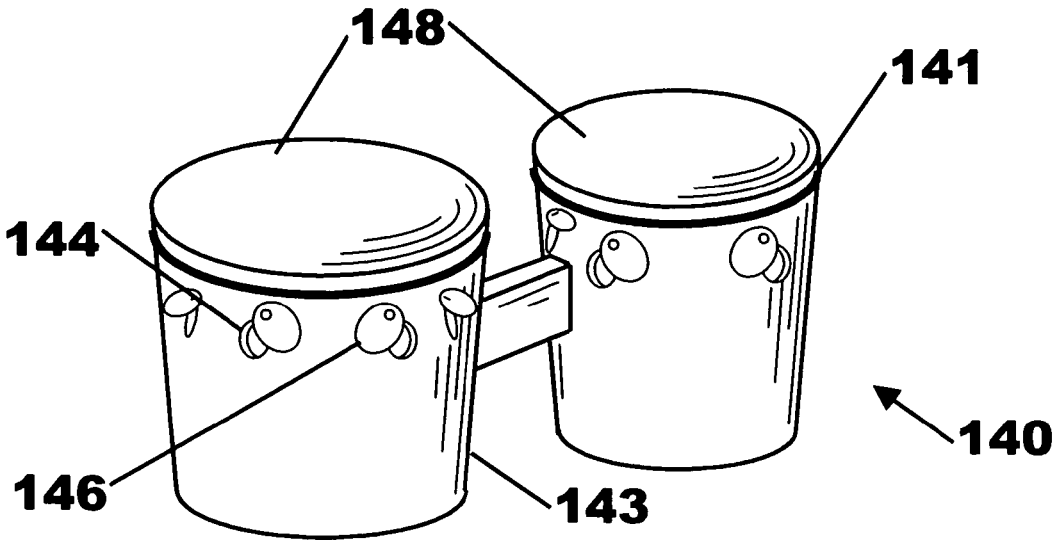
FIG. 16 is an isometric view of standard Bongo drums having a plurality of acoustical air vent holes beside to the top of the drumhead, and disk members rotatable back and forth to vary size of the air vent openings.

Referring to the drawings by numerals of reference, and especially to FIG. 16 show a Bongo drum assembly 140 with the drum-tensioning hoop 141 supported on drum shell 143. Conventional adjusting screws secure drum-tensioning hoop 141 on the drum shell 143. Adjustment of the bolts or screws varies the tension in the drumhead skin 148 or diaphragm to tune the sound of the drumheads.

Drum shell 143 has a plurality of acoustic vent openings 144, which allow air to exit from the interior of the drum. Valve disks 146 are positioned next to each opening 144, and are pivotable side to side to open or close the vent openings. This adjustment of the acoustic openings allows variation in venting of air from the drum for controlling volume, pitch, tone, timbre, and stick or hand response.

Operation

With the drumhead secured on the open upper end of drum shell 143, the drum is ready for use. Adjustment of the acoustic openings 144 by movement of disks 146 allows a variation in venting of air from the drum. This adjustment of the acoustic openings allows variation in venting of air from the drum for controlling volume, pitch, tone, timbre, and stick or hand response.

EXAMPLE 17

Figure 17:
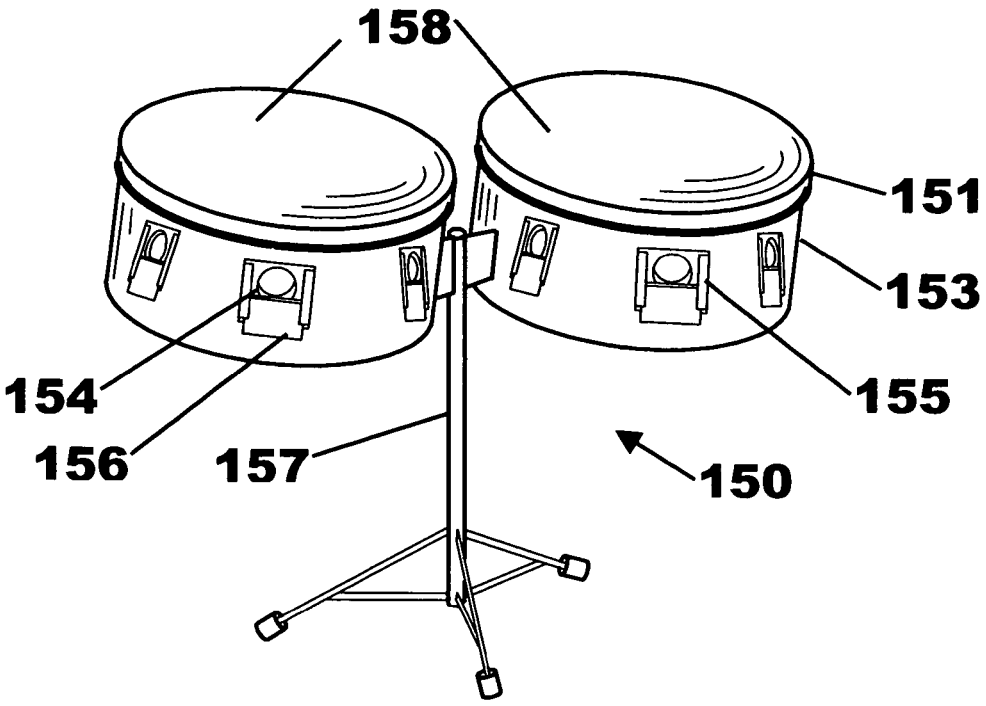
FIG. 17 is an isometric view of standard Timbales drums having a plurality of acoustic air vent holes beside to the top drumhead, and slide members slidable up and down to vary the size of the air vent openings.

Referring to the drawings by numerals of reference, and especially to FIG. 17 shows Timbale drum assembly 150 with drum tensioning hoop 151 supported on drum shell 153. Conventional adjusting screws secure drum-tensioning hoops 151 on the drum shell 153. Adjustment of the bolts or screws varies the tension in the drumhead skin 158 or diaphragm to tune the sound of the drumheads.

Drum shell 153 has a plurality of acoustic vent openings 154, which allow air to exit from the interior of the drum. Guide members 155 are provided for each of the vent openings 154. Valve slides 156 are positioned in each of the guide members 155, and are slidable from a lower position opening said vent openings to an upper position closing the openings. Valve slides 156 can be moved individually as disclosed in FIG. 11 or can be individually adjusted as disclosed in this FIG. 15. This adjustment of the acoustic openings allows variation in venting of air from the drum for controlling volume, pitch, tone, timbre, and stick or hand response. The drums in this figure are shown installed onto a drum stand 157.

Operation

When the drumhead is secured on the open upper end of drum shell 153, the drum is ready for use. Adjustment of the acoustic openings 154 by movement within the slides 156 allows a variation in venting of air from the drum. This adjustment of the acoustic openings allows variation in venting of air from the drum for controlling volume, pitch, tone, timbre, and stick or hand response.

While this invention has been described fully and completely with special emphasis upon several preferred embodiments, it should be understood that within the scope of the appended claims, the invention can be practiced otherwise than as specifically described herein.

What is claimed is:

1. A tunable drum comprising:

a hollow drum shell, a drumhead closing at least one end of said drum shell, at least one opening in the side of said drum shell for acoustic venting, and valve means for adjusting the size of said opening to vary the amount of acoustic venting.

2. A drum according to claim 1 in which the variation in acoustic venting varies the volume, pitch, tone, timbre and hand or stick response of said drum.

3. The valve according to claim 1 in which the valve comprises at least one of a slide valve, rotational valve, screw valve or pivoting valve located internal or external of the drum shell.

4. The drum according to claim 1 in which the drum further includes at least one additional acoustic venting opening in the said drum shell for adjustable acoustic venting.

5. A drum according to claim 1, in which the drum is constructed modularly where the shell and the venting valve or valves are constructed of separate components.

6. A modular drum construction according to claim 5, in which the venting valve or valves are located in either or both of the separate shell and venting pieces.

7. A tunable drum comprising, a hollow drum shell, drumhead closing at least one end of said drum shell, at least one opening through the side of said drum shell for acoustic venting, means for adjusting the size of said opening to vary the amount of acoustic venting, and said size adjusting means comprises a slide valve movable between an open and a closed position.

8. A drum according to claim 7, in which said drum shell has a plurality of venting openings, and said size adjusting means comprises a plurality of valves movable between an open and a closed position.

9. A drum according to claim 8, including means for moving said valves together.

10. A drum according to claim 7, in which said valves are movable pivotally between an open and a closed position.

11. A drum according to claim 7, in which said drum has a first plurality of coplanar venting openings around the periphery thereof and a second plurality of coplanar venting openings around the periphery thereof spaced from said first plurality of openings, said size adjusting means comprises a ring member with a plurality of valves movable between an open and a closed position, and means for moving said valves between an open and a closed position.

12. A drum according to claim 7, in which said drum has a first plurality of venting openings around the periphery thereof and a second plurality of coplanar venting openings around the periphery thereof spaced from said first plurality of openings, said size adjusting means comprises a first ring member having openings corresponding to said first plurality of drum venting openings, and a second ring member having openings corresponding to said second plurality of drum venting openings said first and second ring members being movable between an open and a closed position relative to said drum venting openings, and an operating member secured to said first and said second ring members for moving the said first and second rings together to adjust the openings between said open and closed positions.

13. A drum according to claim 7, in which said drum has a plurality of venting openings said valve means comprises a ring member having openings corresponding to said drum venting openings, said ring member being movable between an open and a closed position relative to said openings, and said size adjusting means comprises means for moving said ring member between said open and closed positions.

14. A drum according to claim 11 in which said ring member is positioned for rotation and or vertical movement inside said drum.

15. A drum according to claim 11, in which said ring member is imperforate and positioned for rotation and endwise sliding movement inside said drum to cover or uncover said venting openings.

16. A drum according to claim 11, in which said ring member is positioned for rotation outside said drum.

17. A drum according to claim 11, in which said ring member is positioned for rotation inside said drum, and including an operating member secured on said ring member and extending outside said drum for operating ring member.

18. A drum according to claim 11, in which said ring member is positioned for rotation outside said drum, and including an operating member secured on said ring member and extending outside said drum for operating ring member.

19. A drum according to claim 11, in which said ring member is positioned for rotation outside said drum, and including an operating handle secured on said ring member outside said drum, and said operating handle being effective to rotate said ring member to vary the size of the drum openings.

20. A drum according to claim 11, in which said ring member is positioned for rotation inside said drum, and including a bolt member secured on said ring member and extending outside said drum, and said bolt member being effective to rotate said ring member to vary the size of the drum openings and on turning to a tightened position to fix said ring member in position.

* * * * *